US009903094B2

(12) United States Patent
Takahashi

(10) Patent No.: US 9,903,094 B2
(45) Date of Patent: Feb. 27, 2018

(54) WORK MACHINE DRIVING DEVICE

(71) Applicant: Hitachi Construction Machinery Co., Ltd., Bunkyo-ku, Tokyo (JP)

(72) Inventor: Hiromasa Takahashi, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 200 days.

(21) Appl. No.: 14/915,344

(22) PCT Filed: Nov. 7, 2014

(86) PCT No.: PCT/JP2014/079646
§ 371 (c)(1),
(2) Date: Feb. 29, 2016

(87) PCT Pub. No.: WO2015/076130
PCT Pub. Date: May 28, 2015

(65) Prior Publication Data

US 2016/0208459 A1 Jul. 21, 2016

(30) Foreign Application Priority Data

Nov. 21, 2013 (JP) ..... 2013-240933

(51) Int. Cl.
*F15B 11/17* (2006.01)
*E02F 3/43* (2006.01)
*E02F 9/22* (2006.01)

(52) U.S. Cl.
CPC ..... *E02F 3/435* (2013.01); *E02F 9/2207* (2013.01); *E02F 9/2235* (2013.01); (Continued)

(58) Field of Classification Search
CPC ..... E02F 9/22; E02F 9/2207; E02F 9/2235; E02F 9/2292; F15B 11/17; F15B 2211/20576; F15B 2211/71
See application file for complete search history.

(56) References Cited

U.S. PATENT DOCUMENTS 4,369,625 A * 1/1983 Izumi ..... E02F 9/2292 414/699
8,978,373 B2 * 3/2015 Opdenbosch ..... E02F 9/2242 60/421
2013/0098016 A1 4/2013 Opdenbosch et al.

FOREIGN PATENT DOCUMENTS

EP 0 076 485 A1 4/1983
GB 2 045 360 A 10/1980
(Continued)

OTHER PUBLICATIONS

Extended European Search Report issued in counterpart European Application No. 14864885.0 dated May 31, 2017 (Eight (8) pages).
(Continued)

*Primary Examiner* — Thomas E Lazo
(74) *Attorney, Agent, or Firm* — Crowell & Moring LLP

(57) ABSTRACT

Provided is a work machine driving device which can reduce unnecessary switching control of switching valves. The present invention is configured so that at least two closed-circuit hydraulic pumps 2*a* to 2*f* can be connected in a closed loop to any one of hydraulic actuators 7*a* to 7*c*, 10*c* through electromagnetic switching valves 12, in which a controller 16 includes a priority order calculating circuit 31 which calculates the allocation of the closed-circuit hydraulic pumps 2*a* to 2*f* to the hydraulic actuators 7*a* to 7*c*, 10*c* according to operation of operation levers 17*a*, 17*b* and a priority order map 32 determining priority connection relationships between the closed-circuit hydraulic pumps 2*a* to 2*f* and the hydraulic actuators 7*a* to 7*c*, 10*c*, and the priority order calculating circuit 31 selects and allocates an unallocated closed-circuit hydraulic pump 2*a* to 2*f* when the number of closed-circuit hydraulic pumps 2*a* to 2*f* to be allocated increases.

2 Claims, 10 Drawing Sheets

(52) U.S. Cl.
CPC ..... *E02F 9/2289* (2013.01); *E02F 9/2292* (2013.01); *E02F 9/2296* (2013.01); *F15B 11/17* (2013.01); *F15B 2211/20561* (2013.01); *F15B 2211/20569* (2013.01); *F15B 2211/20576* (2013.01); *F15B 2211/27* (2013.01); *F15B 2211/30595* (2013.01); *F15B 2211/71* (2013.01)

(56) References Cited

FOREIGN PATENT DOCUMENTS

| | | | |
|---|---|---|---|
| JP | 57-54635 | A | 4/1982 |
| JP | 58-82504 | U | 6/1983 |
| JP | 61-151333 | A | 7/1986 |
| JP | 62-25882 | B2 | 6/1987 |
| JP | 62-165003 | A | 7/1987 |

OTHER PUBLICATIONS

International Search Report (PCT/ISA/210) issued in PCT Application No. PCT/JP2014/079646 dated Jan. 27, 2015, with English translation (four (4) pages).

* cited by examiner

FIG. 4A
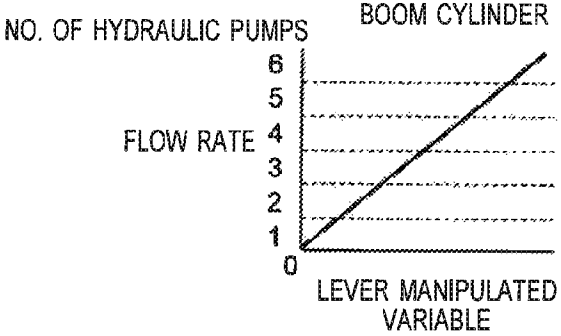
FIG. 4B
FIG. 4C
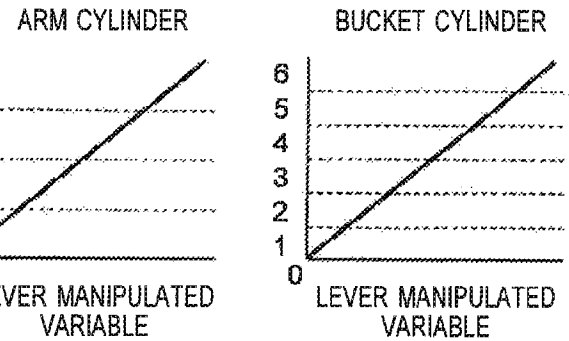
FIG. 4D
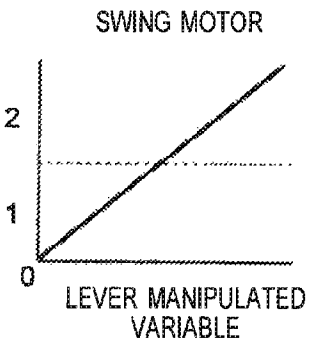

FIG. 5

| ACT \ HYDRAULIC PUMP | P1 | P2 | P3 | P4 | P5 | P6 |
|---|---|---|---|---|---|---|
| BOOM CYLINDER | 1 | 3 | 6 | 2 | 4 | 5 |
| ARM CYLINDER | 2 | 1 | 3 | 4 | - | - |
| BUCKET CYLINDER | 7 | 6 | 1 | 3 | 5 | 2 |
| SWING MOTOR | - | - | - | - | 1 | 3 |

FIG. 6A

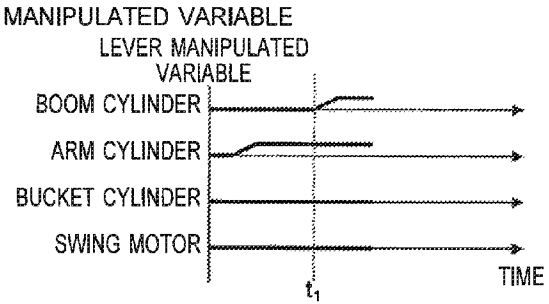

FIG. 6B

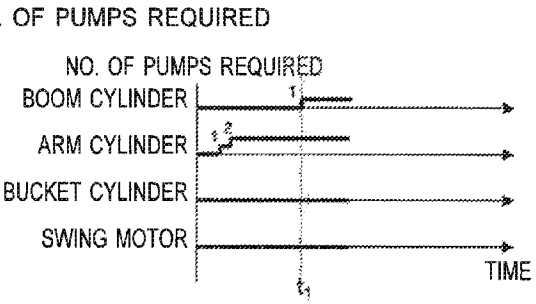

FIG. 6C

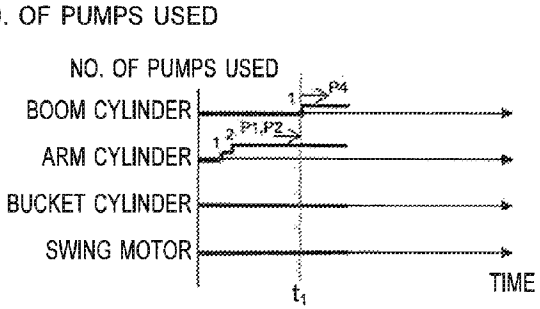

FIG. 6D

SWITCHING VALVE STATE BEFORE TIME t1

| ACT \ HYDRAULIC PUMP | P1 | P2 | P3 | P4 | P5 | P6 |
|---|---|---|---|---|---|---|
| BOOM CYLINDER | off | off | off | off | off | off |
| ARM CYLINDER | on | on | off | off | - | - |
| BUCKET CYLINDER | off | off | off | off | off | off |
| SWING MOTOR | - | - | - | - | off | off |

FIG. 6E

SWITCHING VALVE STATE AT TIME t1 AND AFTER TIME t1

| ACT \ HYDRAULIC PUMP | P1 | P2 | P3 | P4 | P5 | P6 |
|---|---|---|---|---|---|---|
| BOOM CYLINDER | off | off | off | on | off | off |
| ARM CYLINDER | on | on | off | off | - | - |
| BUCKET CYLINDER | off | off | off | off | off | off |
| SWING MOTOR | - | - | - | - | off | off |

FIG. 7A

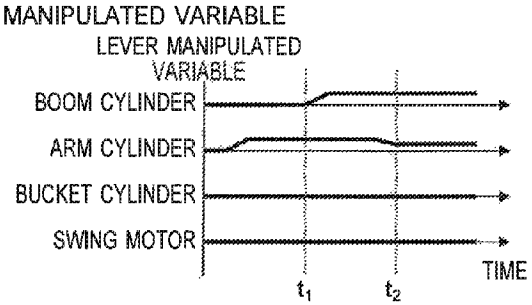

FIG. 7B

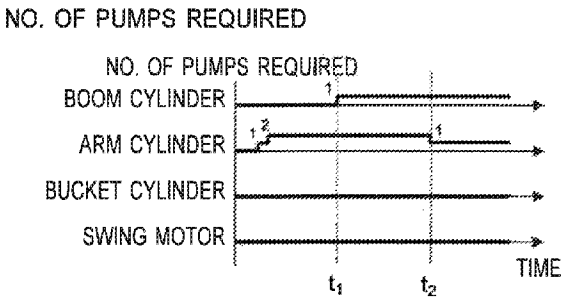

FIG. 7C

FIG. 7D

SWITCHING VALVE STATE FROM TIME t1 BEFORE TIME t2

| ACT / HYDRAULIC PUMP | P1 | P2 | P3 | P4 | P5 | P6 |
|---|---|---|---|---|---|---|
| BOOM CYLINDER | off | off | off | on | off | off |
| ARM CYLINDER | on | on | off | off | - | - |
| BUCKET CYLINDER | off | off | off | off | off | off |
| SWING MOTOR | - | - | - | - | off | off |

FIG. 7E

SWITCHING VALVE STATE AT TIME t2 AND AFTER TIME t2

| ACT / HYDRAULIC PUMP | P1 | P2 | P3 | P4 | P5 | P6 |
|---|---|---|---|---|---|---|
| BOOM CYLINDER | off | off | off | on | off | off |
| ARM CYLINDER | off | on | off | off | - | - |
| BUCKET CYLINDER | off | off | off | off | off | off |
| SWING MOTOR | - | - | - | - | off | off |

FIG. 9A

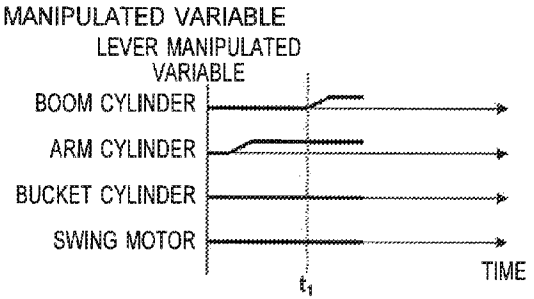

FIG. 9B

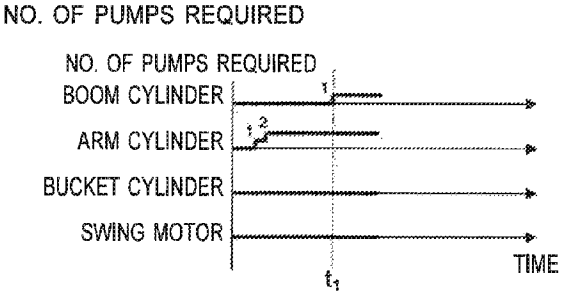

FIG. 9C

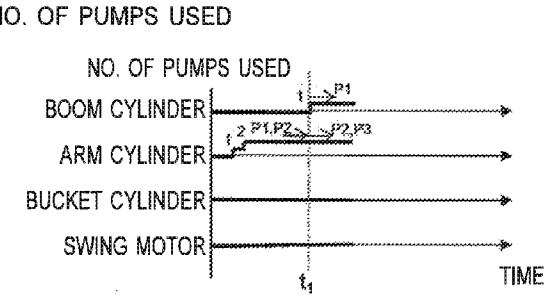

FIG. 9D

SWITCHING VALVE STATE BEFORE TIME t1

| ACT \ HYDRAULIC PUMP | P1 | P2 | P3 | P4 | P5 | P6 |
|---|---|---|---|---|---|---|
| BOOM CYLINDER | off | off | off | off | off | off |
| ARM CYLINDER | on | on | off | off | - | - |
| BUCKET CYLINDER | off | off | off | off | off | off |
| SWING MOTOR | - | - | - | - | off | off |

FIG. 9E

SWITCHING VALVE STATE AT TIME t1 AND AFTER TIME t1

| ACT \ HYDRAULIC PUMP | P1 | P2 | P3 | P4 | P5 | P6 |
|---|---|---|---|---|---|---|
| BOOM CYLINDER | on | off | off | off | off | off |
| ARM CYLINDER | off | on | on | off | - | - |
| BUCKET CYLINDER | off | off | off | off | off | off |
| SWING MOTOR | - | - | - | - | off | off |

FIG. 10A

FIG. 10B

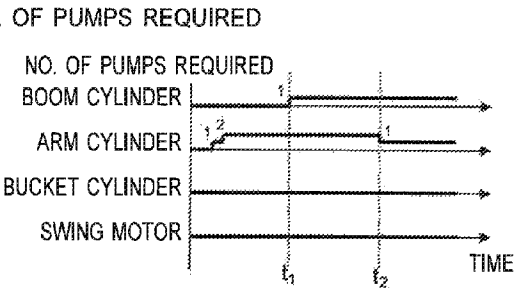

FIG. 10C

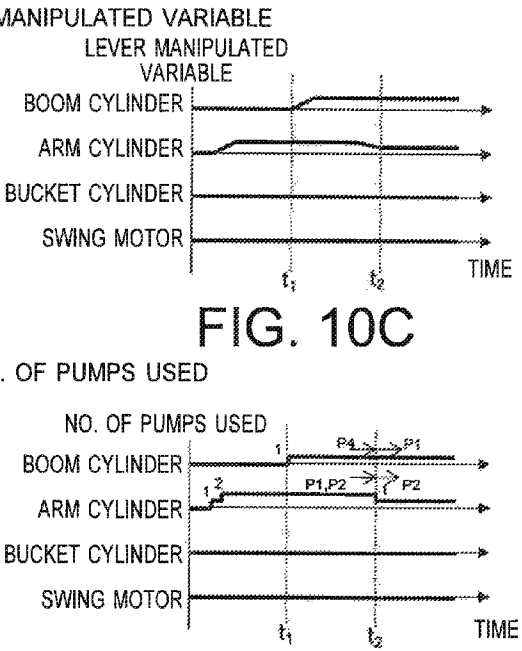

FIG. 10D

SWITCHING VALVE STATE FROM TIME t1 BEFORE TIME t2

| ACT \ HYDRAULIC PUMP | P1 | P2 | P3 | P4 | P5 | P6 |
|---|---|---|---|---|---|---|
| BOOM CYLINDER | off | off | off | on | off | off |
| ARM CYLINDER | on | on | off | off | - | - |
| BUCKET CYLINDER | off | off | off | off | off | off |
| SWING MOTOR | - | - | - | - | off | off |

FIG. 10E

SWITCHING VALVE STATE AT TIME t2 AND AFTER TIME t2

| ACT \ HYDRAULIC PUMP | P1 | P2 | P3 | P4 | P5 | P6 |
|---|---|---|---|---|---|---|
| BOOM CYLINDER | on | off | off | off | off | off |
| ARM CYLINDER | off | on | off | off | - | - |
| BUCKET CYLINDER | off | off | off | off | off | off |
| SWING MOTOR | - | - | - | - | off | off |

WORK MACHINE DRIVING DEVICE

TECHNICAL FIELD

The present invention relates to a driving device used in a work machine such as a hydraulic excavator and more particularly to a driving device which drives a hydraulic actuator through a hydraulic pump.

BACKGROUND ART

In the recent years, energy saving has been demanded from the viewpoint of environmental problems, etc., and in order to achieve energy saving in a work machine such as a hydraulic excavator or wheel loader, it is important to save energy in the entire hydraulic system for driving the work machine. From the viewpoint of energy saving, a hydraulic closed-circuit system has been developed in which a hydraulic pump is connected in a closed loop to a hydraulic actuator to control the hydraulic actuator directly by the hydraulic pump.

Since the hydraulic closed-circuit system does not need a control valve which controls the supply direction and flow rate of hydraulic oil discharged from the hydraulic pump, no pressure loss attributable to the control valve occurs and it is only necessary to discharge hydraulic oil at a required flow rate from the hydraulic pump and there is little flow rate loss. In addition, the potential energy of the hydraulic actuator to be driven and the kinetic energy during deceleration can be regenerated so that energy saving can be achieved.

On the other hand, in the hydraulic closed-circuit system, in order for the amount of hydraulic oil discharged from a single hydraulic pump to cover the required amount of hydraulic oil to drive each hydraulic actuator, a large hydraulic pump with a high discharge rate is needed for each hydraulic actuator. Therefore, Patent Literature 1 discloses a conventional technique which converges flows of hydraulic oil discharged from a plurality of hydraulic pumps and achieves the drive speed of a hydraulic actuator without increasing the size of the hydraulic pumps. In Patent Literature 1, a hydraulic pump is allocated to each hydraulic actuator according to a priority order map which determines priority connection relationships between hydraulic pumps and hydraulic actuators and switching valves are controlled depending on this allocation.

CITATION LIST

Patent Literature

PTL 1: Japanese Examined Patent Publication No. 1987-25882

SUMMARY OF INVENTION

Technical Problem

In the conventional technique disclosed in Patent Literature 1, a hydraulic pump is always allocated to each hydraulic actuator according to the priority order map and switching of the switching valves is controlled depending on the allocation, so the following problems may arise.

For example, if during operation of one hydraulic actuator another hydraulic actuator is to be driven, namely if the number of hydraulic pumps to be allocated increases, it may happen that according to the priority order map the hydraulic pump connected to one hydraulic actuator is connected to the hydraulic actuator to be started according to its priority order and another hydraulic pump is reconnected to the one hydraulic actuator. Also, if during operation of a plurality of hydraulic actuators the flow rate to one hydraulic actuator is decreased for deceleration, namely if the number of hydraulic pumps to be allocated is decreased, the state in which a plurality of hydraulic pumps are allocated to the hydraulic actuator to which the flow rate is decreased is changed to the state in which a certain hydraulic pump among the allocated hydraulic pumps is not connected. Therefore, this certain hydraulic pump becomes unused. However, if the unused hydraulic pump has a higher priority for another hydraulic actuator than the hydraulic pump connected to it, it may happen that according to the priority order map, the hydraulic pump connected to the other hydraulic actuator is unallocated and the unused hydraulic pump is reconnected to it. As a consequence, when changing the connection of a hydraulic pump, it may happen that switching of switching valves is made more times than necessary (hereinafter sometimes called the number of switching times) to perform control. This may result in increased vehicle body vibration due to a shock caused by pressure variation during switching, worsened operability, and shortened life due to deterioration of components including the switching valves.

The present invention has been made in view of the above circumstances of the conventional technique and an object thereof is to provide a work machine driving device which can reduce unnecessary switching control of switching valves.

Solution to Problem

In order to achieve the above object, the present invention is characterized in that a driving device for a work machine includes a plurality of hydraulic actuators, a plurality of variable displacement hydraulic pumps to drive the hydraulic actuators, a plurality of switching valves connected between the hydraulic actuators and the hydraulic pumps, an operation part to operate the hydraulic actuators, and a controller to control the hydraulic pumps and the switching valves, in which at least two of the hydraulic pumps can be connected in a closed loop to any one of the hydraulic actuators through the switching valves, the controller includes a priority order calculating circuit which calculates allocation of the hydraulic pumps to the hydraulic actuators according to operation of the operation part and a priority order map determining priority connection relationships between the hydraulic pumps and the hydraulic actuators, and the priority order calculating circuit selects and allocates an unallocated one of the hydraulic pumps when the number of hydraulic pumps to be allocated increases.

In the present invention thus configured, when the priority order calculating circuit of the controller calculates the allocation of the hydraulic pumps to the hydraulic actuators according to operation of the operation part and the priority order map determining the priority connection relationships between the hydraulic pumps and the hydraulic actuators, if the number of hydraulic pumps to be allocated increases, it allocates an unallocated hydraulic pump just before the increase. As a consequence, if during operation of one hydraulic actuator, another hydraulic actuator is to be driven, namely even if the number of hydraulic pumps to be allocated increases, an unused hydraulic pump can be connected to the hydraulic actuator to be started without changing the connection of the hydraulic pump connected to the one hydraulic actuator, so unnecessary switching control of electromagnetic switching valves can be reduced. As a consequence, the frequency of shock caused by pressure variation during switching can be reduced, leading to reduction of vehicle body vibration, improved operability and improvement in the life of the components including the switching valves.

In addition, the present invention is characterized in that a driving device for a work machine includes a plurality of hydraulic actuators, a plurality of variable displacement hydraulic pumps to drive the hydraulic actuators, a plurality of switching valves connected between the hydraulic actuators and the hydraulic pumps, an operation part to operate the hydraulic actuators, and a controller to control the hydraulic pumps and the switching valves, in which at least two of the hydraulic pumps can be connected in a closed loop to any one of the hydraulic actuators through the switching valves, the controller includes a priority order calculating circuit which calculates allocation of the hydraulic pumps to the hydraulic actuators according to operation of the operation part and a priority order map determining priority connection relationships between the hydraulic pumps and the hydraulic actuators, and when the number of hydraulic pumps to be allocated to a given hydraulic actuator decreases, the priority order calculating circuit maintains allocation of the hydraulic pumps allocated to the other hydraulic actuators than the given hydraulic actuator.

In the present invention thus configured, when the priority order calculating circuit of the controller calculates the number of hydraulic pumps to be allocated to the hydraulic actuators according to operation of the operation part and the priority order map determining the priority connection relationships between the hydraulic pumps and the hydraulic actuators, if the number of hydraulic pumps to be allocated to a given hydraulic actuator decreases, the allocation of the hydraulic pumps allocated to the hydraulic actuators other than the given hydraulic actuator is maintained. Consequently, if during operation of a plurality of hydraulic actuators the flow rate to one hydraulic actuator is decreased for deceleration, namely even if the number of hydraulic pumps to be allocated decreases, a hydraulic pump is unallocated from the hydraulic actuator to which the flow rate is decreased and the allocation of the hydraulic pumps to the other hydraulic actuators is maintained, so unnecessary switching control of the switching valves is reduced. As a consequence, the frequency of shock caused by pressure variation during switching can be reduced, leading to reduction of vehicle body vibration, improved operability and improvement in the life of the components including the switching valves.

Advantageous Effects of Invention

The present invention is configured so that when the priority order calculating circuit calculates the allocation of the hydraulic pumps to the hydraulic actuators according to operation of the operation part and the priority order map determining the priority connection relationships between the hydraulic pumps and the hydraulic actuators, if the number of hydraulic pumps to be allocated increases, it allocates an unallocated hydraulic pump just before the increase. Also the present invention is configured so that if the number of hydraulic pumps to be allocated to a given hydraulic actuator decreases, the allocation of the hydraulic pumps allocated to the other hydraulic actuators than the given hydraulic actuator is maintained. The present invention thus configured can reduce unnecessary switching control of the switching valves. The other issues, configuration and effects will become apparent from the following description of embodiments.

BRIEF DESCRIPTION OF DRAWINGS

FIG. 4 shows graphs which indicate calculations in the required pump number calculating circuit of the controller shown in FIG. 3, in which (a), (b), (c), and (d) are for the boom cylinder, arm cylinder, bucket cylinder, and swing motor, respectively.

FIG. 5 is a table which shows the priority order map of the controller shown in FIG. 3.

FIG. 6 is a time chart which shows the operation of the controller shown in FIG. 3 when the number of pumps required increases, in which (a) indicates the lever manipulated variable, (b) indicates the number of pumps required, (c) indicates the number of pumps used, (d) indicates the state of the switching valves before time t1, and (e) shows the state of the switching valves at time t1 and after time t1.

FIG. 7 is a time chart which shows the operation of the controller shown in FIG. 3 when the number of pumps required decreases, in which (a) indicates the lever manipulated variable, (b) indicates the number of pumps required, (c) indicates the number of pumps used, (d) indicates the state of the switching valves from time t1 before time t2, and (e) indicates the state of the switching valves at time t2 and after time t2.

FIG. 9 is a time chart which shows the operation of a conventional hydraulic excavator when the number of pumps required increases, in which (a) indicates the lever manipulated variable, (b) indicates the number of pumps required, (c) indicates the number of pumps used, (d) indicates the state of the switching valves before time t1, and (e) indicates the state of the switching valves at time t1 and after time t1.

FIG. 10 is a time chart which shows the operation of the conventional hydraulic excavator when the number of pumps required decreases, in which (a) indicates the lever manipulated variable, (b) shows the number of pumps required, (c) indicates the number of pumps used, (d) indicates the state of the switching valves from time t1 before time t2, and (e) indicates the state of the switching valves at time t2 and after time t2.

DESCRIPTION OF EMBODIMENTS

Figure 1:
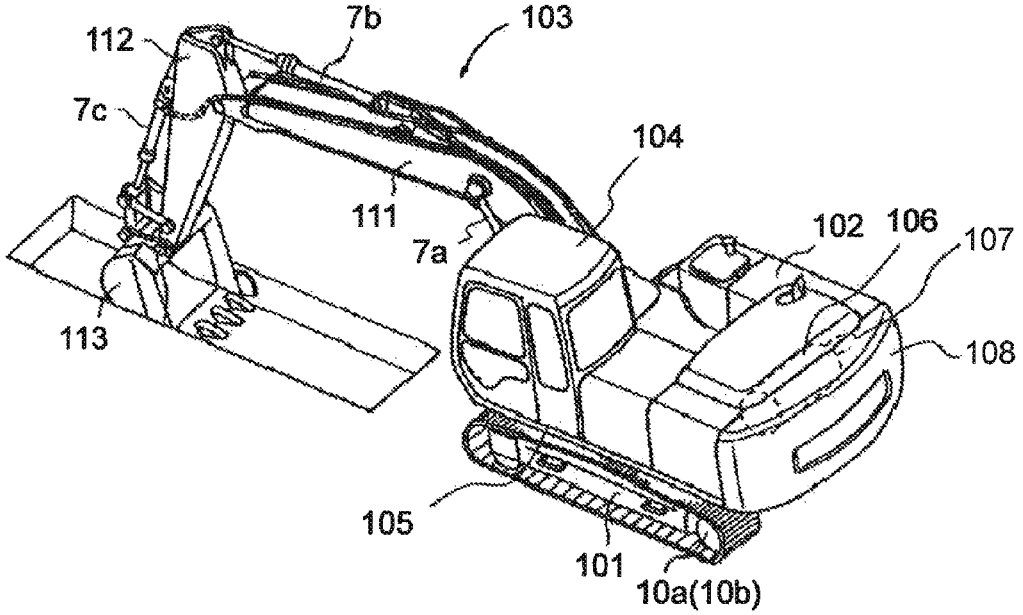
FIG. 1 is a side view which shows a hydraulic excavator including an embodiment of the work machine driving device according to the present invention.

Next, an embodiment of a work machine driving device according to the present invention will be described referring to drawings. FIG. 1 is a side view which shows a hydraulic excavator 1 including an embodiment of the work machine driving device according to the present invention.

The hydraulic excavator 1 as an example of the work machine according to the embodiment of the present invention includes a travel base 101 and a revolving upperstructure 102 over the travel base 101. The main body is comprised of the travel base 101 and the revolving upperstructure 102. The travel base 101 has crawler belts on the left and right sides of the main body and traveling motors 10*a*, 10*b* which are hydraulic actuators to give traveling power to the left and right crawler belts. The revolving upperstructure 102 is rotatable with respect to the travel base 101 by means of a bearing mechanism (not shown) interposed between it and the travel base 101 and a swing motor 10*c* as a hydraulic actuator. In the revolving upperstructure 102, a working device 103 is mounted in front of a main frame 105 and a counterweight 108 is mounted on the back and a cab 104 is mounted on the left front. An engine 106 as a motor and a drive system 107 to be driven by driving power from the engine 106 are housed in the front part of the counterweight 108.

The working device 103 is a front work machine which has a structure comprised of a boom 111, arm 112 and bucket 113 connected by a link mechanism and makes rotary movement around each link axis to perform excavation work or the like. The working device 103 has a boom cylinder 7*a*, an arm cylinder 7*b*, and a bucket cylinder 7*c* which rotate the boom 111, arm 112, and bucket 113.

Figure 2:
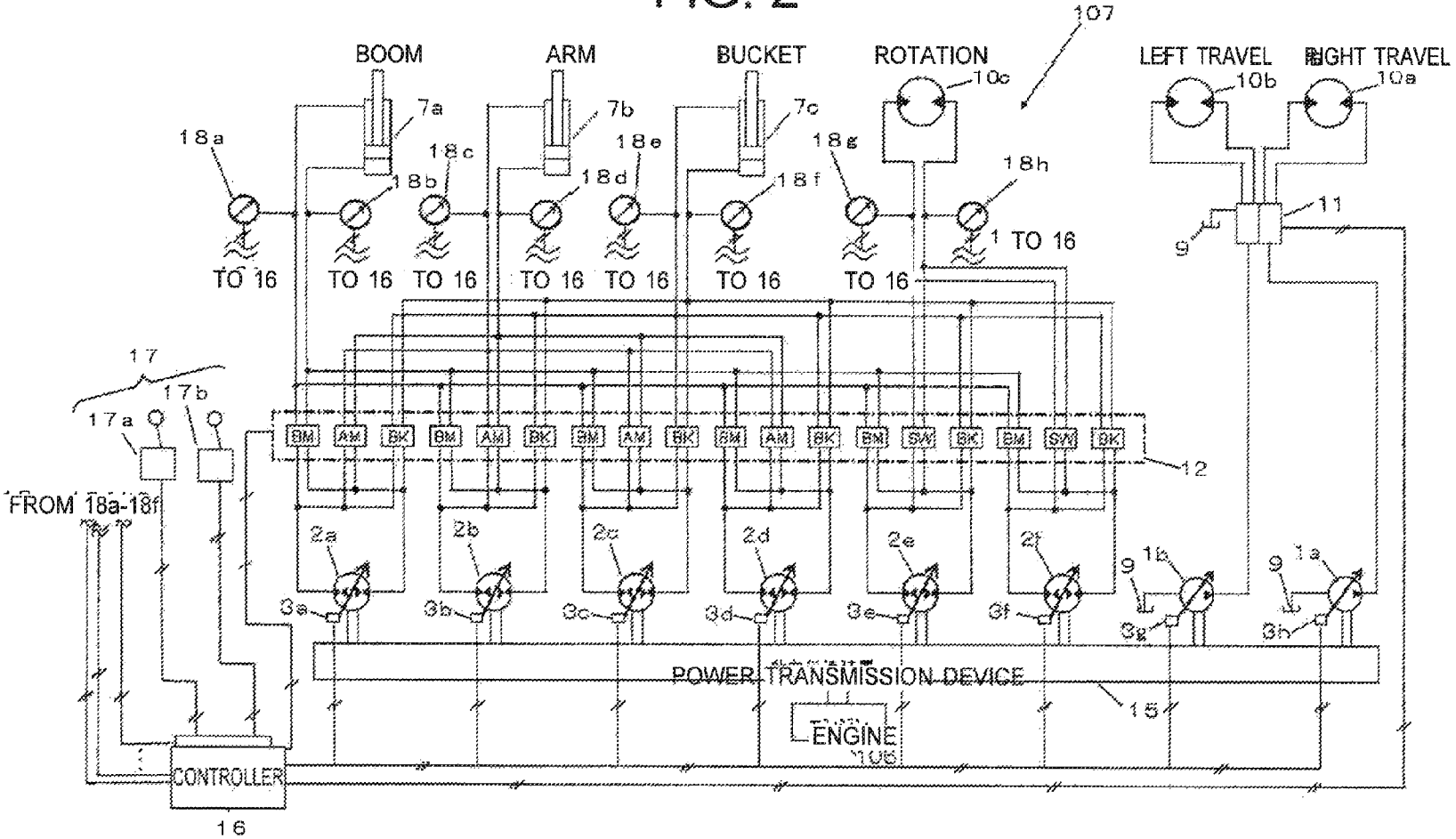
FIG. 2 is a circuit configuration diagram which shows the essential part of the driving device provided in the hydraulic excavator shown in FIG. 1.

FIG. 2 is a circuit configuration diagram which shows the essential part of the driving device provided on the hydraulic excavator 1 shown in FIG. 1. In the description of the driving device, response time from an instruction to operation is not taken into consideration.

As shown in FIG. 2, the drive system 107 as a driving device includes variable displacement closed-circuit hydraulic pumps 2*a* to 2*f* (hereinafter sometimes simply called hydraulic pumps), a hydraulic closed-circuit system in which the boom cylinder 7*a*, arm cylinder 7*b*, bucket cylinder 7*c* and swing motor 10*c* are connected by piping without control valves, and a hydraulic open-circuit system in which variable displacement open-circuit hydraulic pumps 1*a*, 1*b* and the traveling motors 10*a*, 10*b* are connected by piping through a control valve 11 as a hydraulic controller for controlling the supply flow rate and the supply direction.

Although the hydraulic closed-circuit system and hydraulic open-circuit system are mixed in this embodiment, the invention is not limited thereto but depending on the application purpose of the work machine, it may be embodied in another form: for example, a hydraulic closed-circuit system is used for all hydraulic actuators.

Next, the above hydraulic closed-circuit system will be described.

The hydraulic closed-circuit system includes an engine 106, a power transmission device 15 comprised of a gear mechanism, etc., for example, a total of six closed-circuit hydraulic pumps 2*a* to 2*f* to which driving power as torque and revolving speed is supplied by the engine 106 through the power transmission device 15, and hydraulic regulators 3*a* to 3*f* as discharge rate varying devices which can vary the discharge rates of the closed-circuit hydraulic pumps 2*a* to 2*f*. The hydraulic closed-circuit system includes: the boom cylinder 7*a*, arm cylinder 7*b*, bucket cylinder 7*c* and swing motor 10*c*; electromagnetic valves 12 as connecting devices for enabling hydraulic closed-loop connection of at least one of the closed-circuit hydraulic pumps 2*a* to 2*f* to the boom cylinder 7*a*, arm cylinder 7*b*, bucket cylinder 7*c* and swing motor 10*c*; an operation device 17 which generates a lever manipulated variable as an operation signal to the boom cylinder 7*a*, arm cylinder 7*b*, bucket cylinder 7*c* and swing motor 10*c*; and a controller 16 as a control device which controls the hydraulic regulators 3*a* to 3*f* and the electromagnetic valves 12 depending on the lever manipulated variable of the operation device 17.

The closed-circuit hydraulic pumps 2*a* to 2*f* are two-way discharge mechanisms which can discharge hydraulic oil (pressure oil) from two connection ports of the closed-circuit hydraulic pumps 2*a* to 2*f* in order to give the drive direction and the discharge rate of the boom cylinder 7*a*, arm cylinder 7*b*, bucket cylinder 7*c* and swing motor 10*c*. The two-way discharge mechanisms are controlled by the hydraulic regulators 3*a* to 3*f*.

When hydraulic oil is discharged from one of the two connection ports of the closed-circuit hydraulic pump 2*a* to 2*f* by the two-way discharge mechanisms, connection is made to one of the two connection ports of any hydraulic actuator among the boom cylinder 7*a*, arm cylinder 7*b*, bucket cylinder 7*c* and swing motor 10*c* through the electromagnetic switching valve 12 and the hydraulic oil returned from the other connection port of the two connection ports of the hydraulic actuator is returned to the other connection port of the two connection ports of the closed-circuit hydraulic pump 2*a* to 2*f* through the electromagnetic valves 12. In short, the hydraulic oil circulates between the closed-circuit hydraulic pump 2*a* to 2*f* and the hydraulic actuator without returning to a hydraulic oil tank 9, thereby making up a hydraulic closed circuit.

In the hydraulic closed-circuit system, the potential energy of the boom 111 and arm 112 which is generated when the boom 111 and arm 112 move down in the direction of gravitational force or when the rotary motion of the revolving upperstructure 102 is stopped and the kinetic energy of the revolving upperstructure 102 are turned into regenerative energy which is transmitted to the return hydraulic oil and conveyed to one of the closed-circuit hydraulic pumps 2*a* to 2*f*. At this time, the closed-circuit hydraulic pumps 2*a* to 2*f* perform regenerative operation by the regenerative energy. The regenerative energy is conveyed as driving power to another one of the closed-circuit hydraulic pumps 2*a* to 2*f* which drives another hydraulic actuator through the power transmission device 15. As a consequence, for the engine 106, energy is saved by the amount equivalent to the regenerative energy.

Although omitted in FIG. 2, the hydraulic closed-circuit system includes: a charge pump which increases the circuit pressure to prevent cavitation; a make-up check valve; a flushing valve which absorbs the flow rate difference between the head side and rod side of the hydraulic actuator as a single-rod hydraulic cylinder and changes the hydraulic oil in the closed circuit; and a relief valve which relieves the hydraulic oil when the hydraulic oil pressure reaches a prescribed value or more.

The electromagnetic valves 12 include a total of eighteen valves including "BM" switching valves, "AM" switching valves, "BK" switching valves and "SW" switching valves for connecting two or more ones of the closed-circuit hydraulic pumps 2*a* to 2*f* to one of the boom cylinder 7*a*, arm cylinder 7*b*, bucket cylinder 7*c* and swing motor 10*c*.

Among the electromagnetic switching valves 12, the "BM" switching valve is a switching valve for connection to the boom cylinder 7*a* which enables connection of at most all the closed-circuit hydraulic pumps 2*a* to 2*f* located upstream of the electromagnetic switching valves 12. The "AM" switching valve is a switching valve for connection to the arm cylinder 7*b* which enables connection of at most the closed-circuit hydraulic pumps 2*a* to 2*d* among the closed-circuit hydraulic pumps 2*a* to 2*f* located upstream of the electromagnetic switching valves 12. The "BK" switching valve is a switching valve for connection to the bucket cylinder 7*c* which enables connection of at most all the closed-circuit hydraulic pumps 2*a* to 2*f* located upstream of the electromagnetic switching valves 12. The "SW" switching valve is a switching valve for connection to the swing motor 10*c* which enables connection of at most the two closed-circuit hydraulic pumps 2*e* and 2*f* among the closed-circuit hydraulic pumps 2*a* to 2*f* located upstream of the electromagnetic switching valves 12.

The form of connection of the electromagnetic switching valves 12 is not limited to the above but another form of connection may be adopted depending on the application purpose of the work machine.

The cab 104 where an operator boards is equipped with the operation device 17 to give an operation instruction to each hydraulic actuator. The operation device 17 has operation levers 17*a*, 17*b* which can tilt back and forth and left and right and a detector (not shown) which electrically detects the amount of tilt of the operation lever 17*a*, 17*b* as an operation signal, namely a lever manipulated variable, and outputs the lever manipulated variable detected by the detector as a lever manipulated variable signal to the controller 16 through an electric wire.

The operation device 17 has a mechanism which electrically detects the lever manipulated variable but instead it may have another type of mechanism such as a hydraulic mechanism. In the case of a hydraulic mechanism, typically it is a mechanism which has a pilot hydraulic pump separately and reduces the discharge pressure of the hydraulic pump depending on the lever manipulated variable.

The controller 16 performs prescribed control calculations and outputs an opening instruction signal to the hydraulic regulators 3*a* to 3*f*, outputs a switching valve connection instruction signal to the electromagnetic switching valves 12 to control them. In other words, the controller 16 controls the hydraulic regulators 3*a* to 3*f*, the electromagnetic switching valves 12, and the control valve 11 according to such information as the lever manipulated variable signal outputted from the operation device 17 and hydraulic oil pressure signals outputted from pressure sensors 18*a* to 18*h* connected to the connection ports of the hydraulic actuators.

In the hydraulic open-circuit system, as mentioned above, the control valve 11 to give the drive direction and discharge rate of the traveling motors 10*a*, 10*b* is located downstream. The open-circuit hydraulic pumps 1*a* and 1*b* are one-way discharge mechanisms with two connection ports in which one of the two connection ports is connected to the hydraulic oil tank 9 by piping as a suction port for suction from the hydraulic oil tank 9 for storing pressure oil temporarily. The other connection port of the open-circuit hydraulic pumps 1*a*, 1*b* is connected as a discharge port to the connection port of the control valve 11. The discharge rate from the discharge port is controlled by the one-way discharge mechanism. The one-way discharge mechanism is controlled by the hydraulic regulators 3*g*, 3*h*.

The return hydraulic oil from the traveling motors 10*a*, 10*b* goes back to the hydraulic oil tank 9 through the control valve 11. The control valve 11 and the hydraulic regulators 3*g*, 3*h* are controlled depending on the lever manipulated variable generated by the operation device (not shown) provided in the cab 104. The lever manipulated variable is outputted to the controller 16. The controller 16 performs control calculations which are different from those for the hydraulic closed-circuit system, makes conversion into an output signal and outputs it to the control valve 11 and the hydraulic regulators 3*g*, 3*h* through an electric wire.

Figure 3:
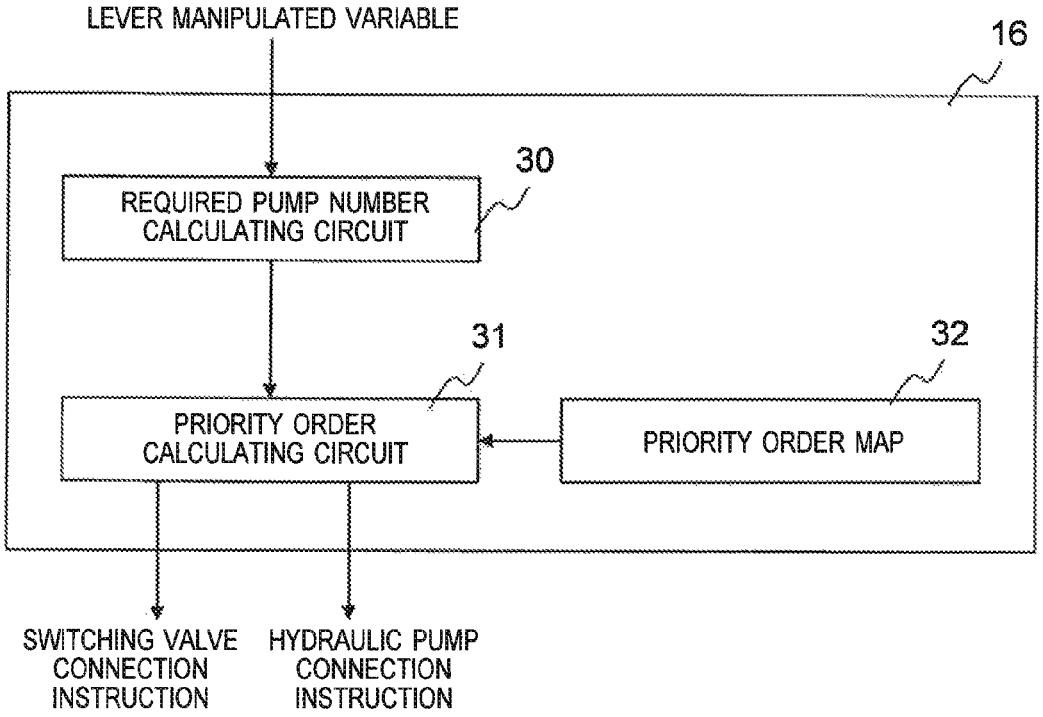
FIG. 3 is a block diagram which shows a controller in the driving device shown in FIG. 2.

Next, the configuration of the controller 16 will be described referring to FIG. 3. FIG. 3 is a block diagram which shows the controller in the driving device shown in FIG. 2. FIG. 4 shows graphs which indicate calculations in the required pump number calculating circuit 30 of the controller 16 shown in FIG. 3, in which (a), (b), (c), and (d) are for the boom cylinder 7*a*, arm cylinder 7*b*, bucket cylinder 7*c*, and swing motor 10*c*, respectively. FIG. 5 is a table which shows the priority order map of the controller 16 shown in FIG. 3.

The controller 16 includes a required pump number calculating circuit 30, a priority order calculating circuit 31, and a priority order map 32. The required pump number calculating circuit 30 calculates the number of pumps required to be connected to a hydraulic actuator according to the manipulated variable of the operation levers 17*a*, 17*b* of the operation device 17, namely the lever manipulated variable. As indicated in FIG. 4(*a*) to FIG. 4(*d*), the required pump number calculating circuit 30 calculates the number of hydraulic pumps required from the hydraulic oil amount required to drive the boom cylinder 7*a*, arm cylinder 7*b*, bucket cylinder 7*c*, and swing motor 10*c*, according to the lever manipulated variable signal outputted from the operation device 17 upon operation of the operation levers 17*a*, 17*b*. FIG. 4(*a*) to FIG. 4(*d*) show an example that the amount of hydraulic oil increases in proportion to the lever manipulated variable but instead a different specification may be adopted depending on the work machine.

The priority order map 32 determines the priority connection relationships between the closed-circuit hydraulic pumps 2*a* to 2*f* and the hydraulic actuators as the boom cylinder 7*a*, arm cylinder 7*b*, bucket cylinder 7*c*, and swing motor 10*c* and as shown in FIG. 5, the vertical axis represents the hydraulic actuators and the horizontal axis represents the closed-circuit hydraulic pumps 2*a* to 2*f*, and for example, "1", "2" . . . "7" are indicated as priorities in the boxes corresponding to the axes. "-" in a box expresses that the closed-circuit hydraulic pumps 2*a* to 2*f* and hydraulic actuators are not connected through the electromagnetic switching valves 12.

For example, if the actuator to be operated is the boom cylinder 7*a* which requires a high flow rate, when the closed-circuit hydraulic pumps 2*a* to 2*f* are expressed by P1 to P6 respectively, the connectable hydraulic pumps are all P1 to P6 and the order of connection is P1, P4, P2, P5, P6, and P3 in the order of mention. If the actuator to be operated is the arm cylinder 7*b*, the connectable hydraulic pumps are P1 to P4 and the order of connection is P2, P1, P3, and P4 in the order of mention. If the actuator to be operated is the bucket cylinder 7*c* which requires a high flow rate, the connectable hydraulic pumps are all P1 to P6 and the order of connection is P3, P6, P5, P5, P2, and P1 in the order of mention. If the actuator to be operated is the swing motor 10*c* which only requires a low flow rate, the connectable hydraulic pumps are P5 and P6 and the order of connection is P5 and P6 in the order of mention. The numbers "1" to "7" in the priority order map 32 indicate the priority order in which higher priority is given to connect a given closed-circuit hydraulic pump 2*a* to 2*f* to a hydraulic actuator corresponding to a smaller number.

The priority order calculating circuit 31 calculates the allocation of the closed-circuit hydraulic pumps 2*a* to 2*f* to the hydraulic actuators according to the number of pumps required calculated from the manipulated variable of the operation levers 17*a*, 17*b* by the required pump number calculating circuit 30 and the priority order map 32. A switching valve connection instruction signal for controlling switching of a given electromagnetic switching valve 12 and a hydraulic pump connection instruction for connecting a given closed-circuit hydraulic pump 2*a* to 2*f* are outputted according to the result of calculation by the priority order calculating circuit 31 and switching of the given electromagnetic switching valve 12 is controlled according to the outputted switching valve connection instruction signal and hydraulic pump connection instruction and the closed-circuit hydraulic pumps 2*a* to 2*f* are thus connected to the hydraulic actuators.

Furthermore, the priority order calculating circuit 31 is configured so that when the number of pumps allocated to the closed-circuit hydraulic pumps 2*a* to 2*f* increases (in the case of increase in the number of pumps), the closed-circuit hydraulic pumps 2*a* to 2*f* which are not allocated just before the increase or unused are allocated, and also configured so that when the number of plural closed-circuit hydraulic pumps 2*a* to 2*f* allocated to a given hydraulic actuator decreases (in the case of decrease in the number of pumps), the allocation of the closed-circuit hydraulic pumps 2*a* to 2*f* to the other hydraulic actuators than the given hydraulic actuator is maintained.

Next, the operation of the controller 16 will be described in further detail referring to FIGS. 6 to 8.

FIG. 6 is a time chart which shows the operation of the controller 16 shown in FIG. 3 when the number of pumps required increases, in which (a) indicates the lever manipulated variable, (b) indicates the number of pumps required, (c) indicates the number of pumps used, (d) indicates the state of the electromagnetic switching valves 12 before time t1, and (e) indicates the state of the electromagnetic switching valves 12 at time t1 and after time t1. FIG. 7 is a time chart which shows the operation of the controller 16 shown in FIG. 3 when the number of pumps required decreases, in which (a) indicates the lever manipulated variable, (b) indicates the number of pumps required, (c) indicates the number of pumps used, (d) indicates the state of the electromagnetic switching valves 12 from time t1 before time t2, and (e) indicates the state of the electromagnetic switching valves 12 at time t2 and after time t2. FIG. 8 is a flowchart which shows allocation control of the closed-circuit hydraulic pumps 2*a* to 2*f* by the controller 16 shown in FIG. 3. In FIG. 6(*a*) to FIG. 6(*c*) and FIG. 7(*a*) to FIG. 7(*c*), the horizontal axis represents time, and the vertical axis represents the lever manipulated variable in FIG. 6(*a*) and FIG. 7(*a*) and the number of pumps required in FIG. 6(*b*) and FIG. 7(*b*), and the number of pumps used in FIG. 6(*c*) and FIG. 7(*c*).

For the lever manipulated variable at each time, the required pump number calculating circuit 30 calculates the number of pumps required for the hydraulic actuators as the boom cylinder 7*a*, arm cylinder 7*b*, bucket cylinder 7*c*, and swing motor 10*c*. The priority order calculating circuit 31 calculates the pump allocation of the closed-circuit hydraulic pumps 2*a* to 2*f* according to the number of pumps required at each time as calculated by the required pump number calculating circuit 30 and referring to the priority order map 32.

(In the Case of Increase)

Let's assume, for example, that as shown in FIG. 6(*b*), when before time t1, the number of pumps required for the boom cylinder 7*a* is "0", the number of pumps required for the arm cylinder 7*b* is "2", the number of pumps required for the bucket cylinder 7*c* is "0", and the number of pumps required for the swing motor 10*c* is "0" (hereinafter expressed as "0, 2, 0, 0"), the operation levers 17*a*, 17*b* are operated at time t1 and consequently the number of pumps required becomes "1, 2, 0, 0" or the number of pumps required increases by "1, 0, 0, 0".

Figure 8:
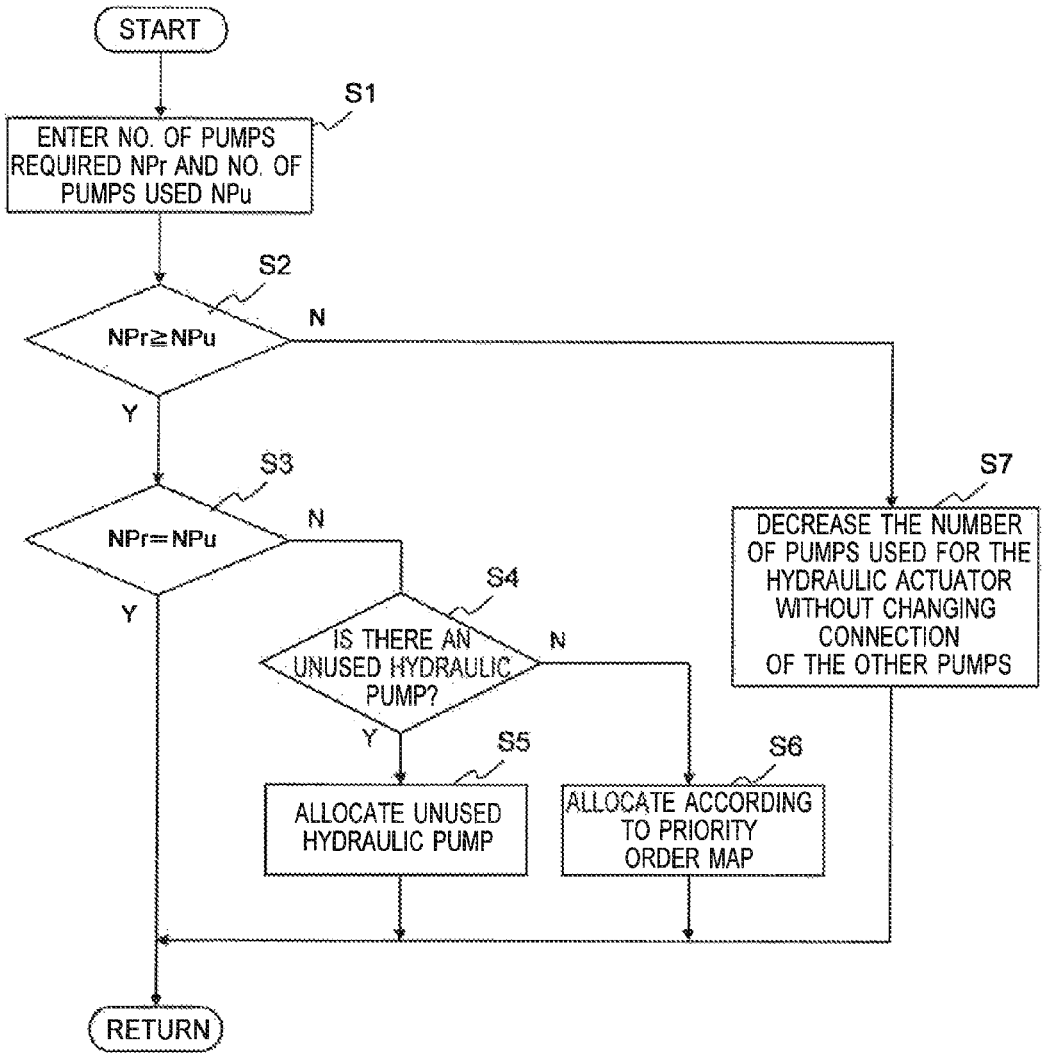
FIG. 8 is a flowchart showing allocation control of the hydraulic pumps by the controller shown in FIG. 3.

In this case, as shown in FIG. 8, the number of pumps required at time t1 and after time t1, "1, 2, 0, 0" and the number of pumps used before time t1 "0, 2, 0, 0" are entered in the priority order calculating circuit 31 (step S1) and whether or not the number of pumps required NPr is the number of pumps used NPu or more, namely NPr≥NPu is decided (step S2). In the flowchart shown in FIG. 8, control begins at START and upon arrival at RETURN, the sequence returns to START. This control is performed in a predetermined cycle by an internal timer (not shown) provided in the controller 16.

If it is decided at step S2 that the number of pumps required NPr is the number of pumps used NPu or more (Yes), whether or not the number of pumps required NPr is equal to the number of pumps used NPu, namely NPr=NPu, is decided (step S3).

If it is decided at step S3 that the number of pumps required NPr is equal to the number of pumps used NPu (Yes), calculation for allocation of the closed-circuit hydraulic pumps 2*a* to 2*f* is not newly performed. On the other hand, if it is decided at the step S3 that the number of pumps required NPr is not equal to the number of pumps used NPu (No), whether or not there is an unused pump among the closed-circuit hydraulic pumps 2*a* to 2*f* is decided (step S4).

If it is decided at the step S4 that there is an unused pump among the closed-circuit hydraulic pumps 2*a* to 2*f* (Yes), the difference between the number of pumps required NPr and the number of pumps used NPu, namely NPr−NPu, is calculated and the unused hydraulic pump is allocated according to the difference (step S5). On the other hand, if it is decided at the step S4 that there is no unused hydraulic pump (No), a given closed-circuit hydraulic pump 2*a* to 2*f* is allocated to a given hydraulic actuator according to the priority order map 32 (step S6).

Specifically, as shown in FIG. 6(*a*), the lever manipulated variable for the boom cylinder 7*a* is entered at time t1 in a manner to be combined with the lever manipulated variable entered before time t1 for the arm cylinder 7*b*. As a consequence, as shown in FIG. 6(*b*), the number of pumps required NPr changes from "0, 2, 0, 0" before time t1 to "1, 2, 0, 0". Also, as shown in FIG. 6(*c*), before time t1 the pumps used are P1 and P2 and the number of pumps used NPu is "0, 2, 0, 0". Next, the number of pumps required NPr "1, 2, 0, 0" and the number of pumps used NPu "0, 2, 0, 0" are entered in the priority order calculating circuit 31 (step S1) and the number of pumps required NPr and the number of pumps used NPu are compared and it is decided that there is an increase of "0, 1, 0, 0", namely the number of pumps required NPr is the number of pumps used NPu or more (step S2). Furthermore, it is decided that the number of pumps required NPr is not equal to the number of pumps used NPu (step S3) and the sequence goes to decision about whether or not there is an unused hydraulic pump. In this case, since there are unused hydraulic pumps P3, P4, P5, and P6, it is decided that there are unused hydraulic pumps, namely YES (step S4), the hydraulic pump with the highest priority for the boom cylinder 7*a* among the unused hydraulic pumps in the priority order map 32 is allocated (step S5). The priorities of the closed-circuit hydraulic pumps 2*a* to 2*f* for the boom cylinder 7*a* are "6" for P3, "2" for P4, "4" for P5, and "5" for P6 as shown in FIG. 5, so P4, which has the highest priority "2", is allocated.

On the other hand, regarding the electromagnetic switching valves 12, as shown in FIG. 6(*d*), before time t1, as P1 and P2 are connected to the arm cylinder 7*b*, the "AM" switching valves located downstream of P1 and P2 are on. Furthermore, as shown in FIG. 6(*e*), at time t1, as the allocated P4 is connected to the boom cylinder 7*a*, the "BM" switching valve located downstream of P4 is on.

As a consequence, as shown in FIG. 6(*b*) and FIG. 6(*c*), the number of pumps used NPu after time t1 meets the number of pumps required NPr and the number of pumps used NPu is the same as the number of pumps required NPr, so the hydraulic actuator operation speed as required is achieved and also the number of switching times of the electromagnetic switching valves 12 is only one for the "BM" switching valve.

(In the Case of Decrease)

Furthermore, when at the step S2 the number of pumps required NPr is not the number of pumps used NPu or more (No), namely the number of pumps required NPr has decreased, if the allocation of the closed-circuit hydraulic pumps 2*a* to 2*f* is returned to the original allocation according to the priority order map 32 shown in FIG. 5, unnecessary switching of the electromagnetic switching valves 12 would be required as described later; for this reason, the number of pumps as closed-circuit hydraulic pumps 2*a* to 2*f* used to drive the hydraulic actuator for which the number of pumps required decreases is decreased and the connection of the closed-circuit hydraulic pumps 2*a* to 2*f* to another hydraulic actuator than the hydraulic actuator concerned, namely the arm cylinder 7*b*, that is the boom cylinder 7*a*, is not changed (step S7).

Specifically, as shown in FIG. 7(*a*), at time t2, the lever manipulated variable of the arm cylinder 7*b*, which is one of the lever manipulated variables of the boom cylinder 7*a* and arm cylinder 7*b* as entered before time t2, decreases. As a consequence, as shown in FIG. 7(*b*), the number of pumps required NPr changes from "1, 2, 0, 0" to "1, 1, 0, 0". Also, as shown in FIG. 7(*c*), the pumps used before time t2 are P1, P2, and P4 and the number of pumps used NPu is "1, 2, 0, 0". Next, as in the case of increase, the number of pumps required NPr "1, 1, 0, 0" and the number of pumps used NPu "1, 2, 0, 0" are entered in the priority order calculating circuit 31 (step S1) and the number of pumps required NPr and the number of pumps used NPu are compared and it is decided that there is a decrease of "0, 1, 0, 0", namely the number of pumps required NPr is smaller than the number of pumps used NPu (step S2). Then, the number of pumps used as the hydraulic pumps connected to the arm cylinder 7*b* as the hydraulic actuator for which the number of required pump decreases is decreased (step S7). As shown in FIG. 5 and FIG. 7(*c*), before time t2, the hydraulic pumps connected to the arm cylinder 7*b* are P1 having priority "2" and P2 having priority "1" and at time t2 the decrease in the number of pumps required is "0, 1, 0, 0", so, as shown in FIG. 5, P1, which has the lower priority "2", is unused.

On the other hand, regarding the electromagnetic switching valves 12, as shown in FIG. 7(*d*), before time t2, as P1 and P2 are connected to the arm cylinder 7*b*, the "AM" switching valves located downstream of P1 and P2 are on. Also, as shown in FIG. 7(*e*), at time t2, as the number of pumps required NPr decreases, the "AM" switching valve located downstream of P1 is off.

As a consequence, P1, having priority "1" for the boom cylinder 7*a*, becomes unused or free but the connection of the closed-circuit hydraulic pumps 2*a* to 2*f* to the other hydraulic actuators than the arm cylinder 7*b* for which the number of pumps required NPr decreases is not changed and as shown in FIG. 7(*c*), the boom cylinder 7*a* remains connected to P4 and is not reconnected to P1. Also, as shown in FIG. 7(*e*), regarding the electromagnetic switching valves 12, after time t2, only the "AM" switching valve changes from the on state to the off state and the number of switching times is only one.

(Conventional Drive System)

Here, operation of the conventional drive system is described referring to FIGS. 9 and 10. FIG. 9 is a time chart which shows the operation of a conventional hydraulic excavator 1 when the number of pumps required increases, in which (a) indicates the lever manipulated variable, (b) indicates the number of pumps required, (c) indicates the number of pumps used, (d) indicates the state of the electromagnetic switching valves 12 before time t1, and (e) indicates the state of the electromagnetic switching valves 12 at time t1 and after time t1. FIG. 10 is a time chart which shows the operation of the conventional hydraulic excavator 1 when the number of pumps required decreases, in which (a) indicates the lever manipulated variable, (b) indicates the number of pumps required, (c) indicates the number of pumps used, (d) indicates the state of the electromagnetic switching valves 12 from time t1 before time t2, and (e) indicates the state of the electromagnetic switching valves 12 at time t2 and after time t2. The horizontal and vertical axes of FIG. 9(*a*) to FIG. 9(*c*) and FIG. 10(*a*) to FIG. 10(*c*) are the same as those of FIG. 6(*a*) to FIG. 6(*c*) and FIG. 7(*a*) to FIG. 7(*c*).

(In the Case of Increase)

As shown in FIG. 9(*b*), before time t1, the number of pumps required for the boom cylinder 7*a* is "0", the number of pumps required for the arm cylinder 7*b* is "2", the number of pumps required for the bucket cylinder 7*c* is "0", and the number of pumps required for the swing motor 10*c* is "0" and this is expressed as "0, 2, 0, 0". In this case, since the number of pumps required for the arm cylinder 7*b* is "2" and the other hydraulic actuators require no pumps, referring to the priority order map 32 shown in FIG. 5, pumps with higher priorities, namely P2 and P1 in the order of mention, are allocated to the arm cylinder 7*b*.

At time t1, as shown in FIG. 9(*a*), the lever manipulated variable for the boom cylinder 7*a* is entered at time t1 in a manner to be combined with the lever manipulated variable entered before time t1 for the arm cylinder 7*b*. As a consequence, as shown in FIG. 9(*b*), the number of pumps required changes from "0, 2, 0, 0" to "1, 2, 0, 0", which means an increase of "1, 0, 0, 0" or change in the number of pumps required for the boom cylinder 7*a* from "0" to "1". In this case, referring to the priority order map 32 shown in FIG. 5, in the closed-circuit hydraulic pumps 2*a* to 2*f* to be allocated to the boom cylinder 7*a*, the priority of P1 is "1", the priority of P4 is "2", and the priority of P2 is "3" and in the closed-circuit hydraulic pumps 2*a* to 2*f* to be allocated to the arm cylinder 7*b*, the priority of P2 is "1", the priority of P1 is "2", and the priority of P3 is "3" and thus P1 has priority "1" for the boom cylinder 7*a* and priority "2" for the arm cylinder 7*b*. Therefore, as shown in FIG. 9(*c*), P1 is reallocated from the arm cylinder 7*b* to the boom cylinder 7*a* for which it has higher priority, and P3, which has priority "3" or next to P1 in priority, is allocated to the arm cylinder 7*b*.

In this case, as shown in FIG. 9(*c*), the number of pumps used meets the number of pumps required and thus the operation speed to be achieved by the number of pumps required is achieved, but as shown in FIG. 9(*d*) and FIG. 9(*e*), regarding the electromagnetic switching valves 12, the "AM" switching valve located downstream of P1 for connection to the arm cylinder 7*b* is changed from the on state to the off state, the "BM" switching valve located downstream of P1 for connection to the boom cylinder 7*a* is changed from the off state to the on state and the "AM" switching valve located downstream of P3 for connection to the arm cylinder 7*b* is changed from the off state to the on state, so three switching times of the electromagnetic switching valves 12 are required.

On the other hand, as shown in FIG. 10(*a*) and FIG. 10(*b*), in the period from time t1 to before time t2, P4 is connected to the boom cylinder 7*a* and P1 and P2 are connected to the arm cylinder 7*b* and at time t2, the number of pumps required changes from "1, 2, 0, 0" to "1, 1, 0, 0", which means a decrease of "0, 1, 0, 0" or change in the number of pumps required for the arm cylinder 7*b* from "2" to "1". In this case, referring to the priority order map 32 shown in FIG. 5, P1 has priority "1" for the boom cylinder 7*a* and priority "2" for the arm cylinder 7*b* and P4 has priority "2" for the boom cylinder 7*a*. Therefore, as shown in FIG. 10(*c*), P1 is reallocated from the arm cylinder 7*b* to the boom cylinder 7*a* for which it has higher priority, and P4 becomes unused.

Regarding the electromagnetic switching valves 12, as shown in FIG. 10(*d*) and FIG. 10(*e*), the "AM" switching valve for connection of P1 to the arm cylinder 7*b* is changed from the on state to the off state, the "BM" switching valve for connection of P1 to the boom cylinder 7*a* is changed from the off state to the on state and the "BM" switching valve for connection of P4 to the boom cylinder 7*a* is changed from the on state to the off state, so three switching times of the electromagnetic switching valves 12 are required.

On the other hand, in the drive system 107 according to the above embodiment of the present invention, for example, as shown in FIG. 6(*b*), if at time t1 the number of pumps required NPr is changed from "0, 2, 0, 0" to "1, 2, 0, 0", or in the case of an increase of "1, 0, 0, 0", and if there is an unused hydraulic pump, the unused hydraulic pump is first allocated as the hydraulic pump to be added when allocating given closed-circuit hydraulic pumps 2*a* to 2*f* to a given hydraulic actuator according to the priority order map 32. In other words, as shown in FIG. 5, since the priorities of the closed-circuit hydraulic pumps 2*a* to 2*f* for the boom cylinder 7*a* are "6" for P3, "2" for P4, "4" for P5, and "5" for P6 as shown in FIG. 5, P4, having the highest priority, is allocated.

As a consequence, the number of pumps used NPu meets the number of pumps required NPr and the number of pumps used NPu is the same as the number of pumps required NPr and thus the hydraulic actuator operation speed as required is achieved and also as shown in FIG. 6(*e*), regarding the electromagnetic switching valves 12, at time t1 only the "BM" switching valve for connection of P4 to the boom cylinder 7*a* is changed from the off state to the on state, so the number of switching times of the electromagnetic switching valves 12 is only one. Therefore, when during operation of one hydraulic actuator another hydraulic actuator is started, namely even when the number of hydraulic pumps to be allocated increases, an unused hydraulic pump is connected to the hydraulic actuator to be started without changing the connection of the hydraulic pump connected to the one hydraulic actuator, so that whereas the number of electromagnetic valve switching times is 3 in the case of increase in the number of pumps required in the conventional drive system, the number of switching times of the electromagnetic switching valves 12 is 1 in the drive system 107 according to the embodiment of the present system, so unnecessary switching control of the electromagnetic switching valves 12 is reduced.

Furthermore, for example, as shown in FIG. 7(*b*), when at time t2 the number of pumps required NPr is changed from "1, 2, 0, 0" to "1, 1, 0, 0" or in the case of decrease of "0, 1, 0, 0", if as shown in FIG. 5 and FIG. 7(*c*), P1 having priority "2" and P2 having priority "1" are used before time t2, P1, having the lower priority "2" for the arm cylinder 7*b* for which the number of pumps required NPr decreases, is unused.

As a consequence, P1, having priority "1" for the boom cylinder 7*a*, becomes unused but the connection of the closed-circuit hydraulic pumps 2*a* to 2*f* to the other hydraulic actuators than the arm cylinder 7*b* for which the number of pumps required NPr decreases is not changed and the boom cylinder 7*a* remains connected (allocated) to P4 and is not reconnected to P1. Also, as shown in FIG. 7(*e*), regarding the electromagnetic switching valves 12, at time t2 only the "AM" switching valve for connection of P1 to the arm cylinder 7*b* is changed from the on state to the off state and the number of switching times of the electromagnetic switching valves 12 is only one.

As a consequence, the number of pumps used NPu meets the number of pumps required NPr, so the hydraulic actuator operation speed as required is achieved and as shown in FIG. 7(*e*), at time t2 the number of switching times of the electromagnetic switching valves 12 is 1. Therefore, if during operation of a plurality of hydraulic actuators the flow rate to one hydraulic actuator is decreased for deceleration, namely even if the number of hydraulic pumps to be allocated decreases, a hydraulic pump is unallocated from the hydraulic actuator to which the flow rate is decreased and the allocation of the hydraulic pumps to the other hydraulic actuators is maintained, so whereas the number of electromagnetic valve switching times is 3 in the case of decrease in the number of pumps required in the conventional drive system, the number of switching times of the electromagnetic switching valves 12 is 1, so unnecessary switching control of the electromagnetic switching valves 12 is reduced.

As mentioned so far, in both the cases of increase and decrease in the number of pumps required, the number of switching times of the electromagnetic switching valves 12 can be decreased, so the frequency of shock caused by hydraulic oil pressure variation during switching of the electromagnetic switching valves 12 can be reduced, which leads to reduction of vehicle body vibration, improved operability and improvement in the life of the components including the electromagnetic switching valves 12. In addition, thanks to the decrease in the number of switching times of the electromagnetic switching valves 12, the power consumption for switching of the electromagnetic switching valves 12 can be reduced.

Other Embodiments

The present invention is not limited to the above embodiment but the invention includes various modified embodiments. For example, the above embodiment has been described for easy understanding of the invention and the invention is not limited to an embodiment which includes the whole configuration described above.

Also, in the above embodiment, an explanation has been made by taking a case that the drive system 107 is mounted on the hydraulic excavator 1 as an example; however the present invention is not limited thereto but the invention can be applied to work machines other than the hydraulic excavator 1, such as hydraulic cranes and wheel loaders, if they have hydraulically drivable hydraulic actuators.

Furthermore, the closed-circuit hydraulic pumps 2*a* to 2*f* of the drive system 107 according to the above embodiment may have the same discharge capacity or may have different discharge capacities.

The above embodiment is configured so that the number of switching times of the electromagnetic switching valves 12 is decreased in both the cases of increase and decrease in the number of pumps required; however, instead a process according to the present invention may be performed so that the number of switching times of the electromagnetic switching valves 12 is decreased only in the case of increase in the number of pumps required or only in the case of decrease in the number of pumps required.

REFERENCE SIGNS LIST

1 . . . hydraulic excavator (work machine),
1*a*, 1*b* . . . open-circuit hydraulic pump,
2*a* to 2*f* . . . closed-circuit hydraulic pump (hydraulic pump),
3*a* to 3*g* . . . hydraulic regulator,
7*a* . . . boom cylinder (hydraulic actuator),
7*b* . . . arm cylinder (hydraulic actuator),
7*c* . . . bucket cylinder (hydraulic actuator),
9 . . . hydraulic oil tank,
10*a*, 10*b* . . . traveling motor,
10*c* . . . swing motor (hydraulic actuator),
11 . . . control valve,
12 . . . electromagnetic switching valve (switching valve),
15 . . . power transmission device,
16 . . . controller,
17 . . . operation device (operation part),
17*a*, 17*b* . . . operation lever,
18*a* to 18*h* . . . pressure sensor,
30 . . . required pump number calculating circuit,
31 . . . priority order calculating circuit,
32 . . . priority order map,
101 . . . travel base,
102 . . . revolving upperstructure,
103 . . . working device,
104 . . . cab,
105 . . . main frame,
106 . . . engine,
107 . . . drive system (driving device),
108 . . . counterweight,
111 . . . boom,
112 . . . arm,
113 . . . bucket

The invention claimed is:

1. A driving device (107) for a work machine (1) comprising:

a plurality of hydraulic actuators (7*a* to 7*c*, 10*c*);

a plurality of variable displacement hydraulic pumps (2*a* to 2*f*) to drive the hydraulic actuators (7*a* to 7*c*, 10*c*);

a plurality of switching valves (12) connected between the hydraulic actuators (7*a* to 7*c*, 10*c*) and the hydraulic pumps (2*a* to 2*f*);

an operation part (17) to operate the hydraulic actuators (7*a* to 7*c*, 10*c*); and a controller (16) to control the hydraulic pumps (2*a* to 2*f*) and the switching valves (12), at least two of the hydraulic pumps (2*a* to 2*f*) connected in a closed loop to any one of the hydraulic actuators (7*a* to 7*c*, 10*c*) through the switching valves (12), wherein: the controller (16) includes a priority order calculating circuit (31) which calculates allocation of the hydraulic pumps (2*a* to 2*f*) to the hydraulic actuators (7*a* to 7*c*, 10*c*) according to operation of the operation part (17) and a priority order map (32) determining priority connection relationships between the hydraulic pumps (2*a* to 2*f*) and the hydraulic actuators (7*a* to 7*c*, 10*c*); and the priority order calculating circuit (31) selects and allocates an unallocated one of the hydraulic pumps (2*a* to 2*f*) when the number of the hydraulic pumps (2*a* to 2*f*) to be allocated increases.

2. A driving device (107) for a work machine (1) comprising:

a plurality of hydraulic actuators (7*a* to 7*c*, 10*c*);

a plurality of variable displacement hydraulic pumps (2*a* to 2*f*) to drive the hydraulic actuators (7*a* to 7*c*, 10*c*);

a plurality of switching valves (12) connected between the hydraulic actuators (7*a* to 7*c*, 10*c*) and the hydraulic pumps (2*a* to 2*f*);

an operation part (17) to operate the hydraulic actuators (7*a* to 7*c*, 10*c*); and a controller (16) to control the hydraulic pumps (2*a* to 2*f*) and the switching valves (12), at least two of the hydraulic pumps (2*a* to 2*f*) connected in a closed loop to any one of the hydraulic actuators (7*a* to 7*c*, 10*c*) through the switching valves (12), wherein: the controller (16) includes a priority order calculating circuit (31) which calculates allocation of the hydraulic pumps (2*a* to 2*f*) to the hydraulic actuators (7*a* to 7*c*, 10*c*) according to operation of the operation part (17) and a priority order map (32) determining priority connection relationships between the hydraulic pumps (2*a* to 2*f*) and the hydraulic actuators (7*a* to 7*c*, 10*c*); and when the number of the hydraulic pumps (2*a* to 2*f*) to be allocated to a given hydraulic actuator (7*a* to 7*c*, 10*c*) decreases, the priority order calculating circuit (31) maintains allocation of the hydraulic pumps (2*a* to 2*f*) allocated to the other hydraulic actuators (7*a* to 7*c*, 10*c*) than the given hydraulic actuator (7*a* to 7*c*, 10*c*).

* * * * *